United States Patent [19]

Hayes

[11] 4,111,367

[45] Sep. 5, 1978

[54] FINGER OPERATED SPRAY PUMP

[75] Inventor: Thomas H. Hayes, Baton Rouge, La.

[73] Assignee: Ethyl Corporation, Richmond, Va.

[21] Appl. No.: 769,934

[22] Filed: Feb. 18, 1977

[51] Int. Cl.[2] ..... B05B 11/00

[52] U.S. Cl. ..... 239/333; 222/321; 239/491

[58] Field of Search ..... 239/333, 491, 493; 222/321, 385, 380, 340

[56] References Cited

U.S. PATENT DOCUMENTS

| | | | |
|---|---|---|---|
| 3,249,259 | 5/1966 | Corsette | 222/321 X |
| 3,482,784 | 12/1969 | Webster | 239/493 |
| 3,877,616 | 4/1975 | Stevens | 222/321 |
| 3,877,617 | 4/1975 | Stevens | 222/321 |
| 4,017,031 | 4/1977 | Kishi | 239/333 |

*Primary Examiner*—John J. Love

*Attorney, Agent, or Firm*—Donald L. Johnson; John F. Sieberth; David L. Ray

[57] ABSTRACT

A finger-operated spray pump assembly including a tank, a primary piston slidably fitted inside the tank, having a liquid passageway, a secondary piston slidably fitted inside the primary piston, and a spring fitted inside the primary piston and the secondary piston for biasing the primary piston away from the secondary piston.

12 Claims, 4 Drawing Figures

FINGER OPERATED SPRAY PUMP

BACKGROUND OF THE INVENTION

The present invention relates to liquid atomizer pumps. In particular, the invention relates to small, hand-held, finger-operated dispensers involving pump assemblages as distinguished from pressurized aerosol containers and valves.

Pumps of the type with which the present invention is concerned include a piston arranged to be driven into the pump housing against a spring pressure so as to deliver the liquid to the nozzle. It is known that in order to obtain the highest possible degree of atomization it is preferable to provide at the pump outlet a so-called turbulence nozzle.

However, it has been found that even the use of a nozzle of this type in prior art atomizing pumps does not completely preclude the occurrence of an insufficient atomization and the formation of droplets in the vicinity of the nozzle, particularly when the pump is subjected to a relatively slow depression movement.

U.S. Pat. No. Re. 28,366, reissued Mar. 18, 1975 to Pechstein discloses an atomizing pump which has as its object the elimination of some of these drawbacks. The Pechstein patent discloses a pump that has a first piston and a second piston, the first piston having a liquid flow passage. A valve which moves relative to the first piston and the second piston is disposed for closing the liquid flow passage in the first piston.

SUMMARY OF THE INVENTION

In accordance with the present invention there is provided a finger operated spray pump assembly including a tank, a primary piston slidably fitted inside the tank having a liquid passageway, a secondary piston slidably fitted inside the primary piston, and a spring fitted inside the primary piston and the secondary piston for biasing the primary piston away from the secondary piston.

DESCRIPTION OF THE PREFERRED EMBODIMENTS

Figure 1:
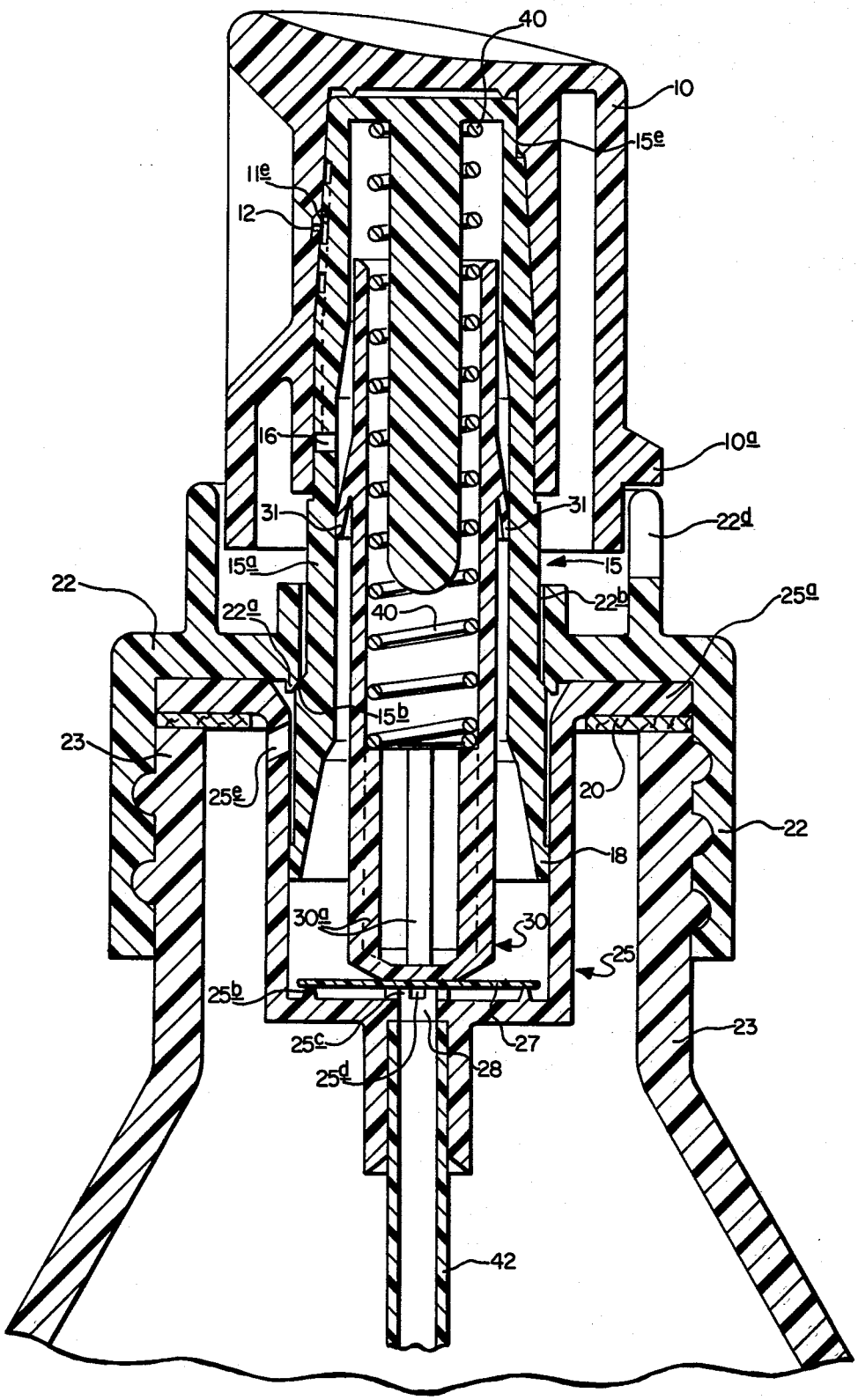
FIG. 1 is an enlarged fragmentary sectional view showing details of the pump.

Referring now to the drawings, the spray pump assembly of the present invention can be seen in FIG. 1 to include a tank which is generally indicated by the numeral 25. Tank 25 houses a primary piston generally indicated by the numeral 15 and a secondary piston generally indicated by the numeral 30.

Figure 2:
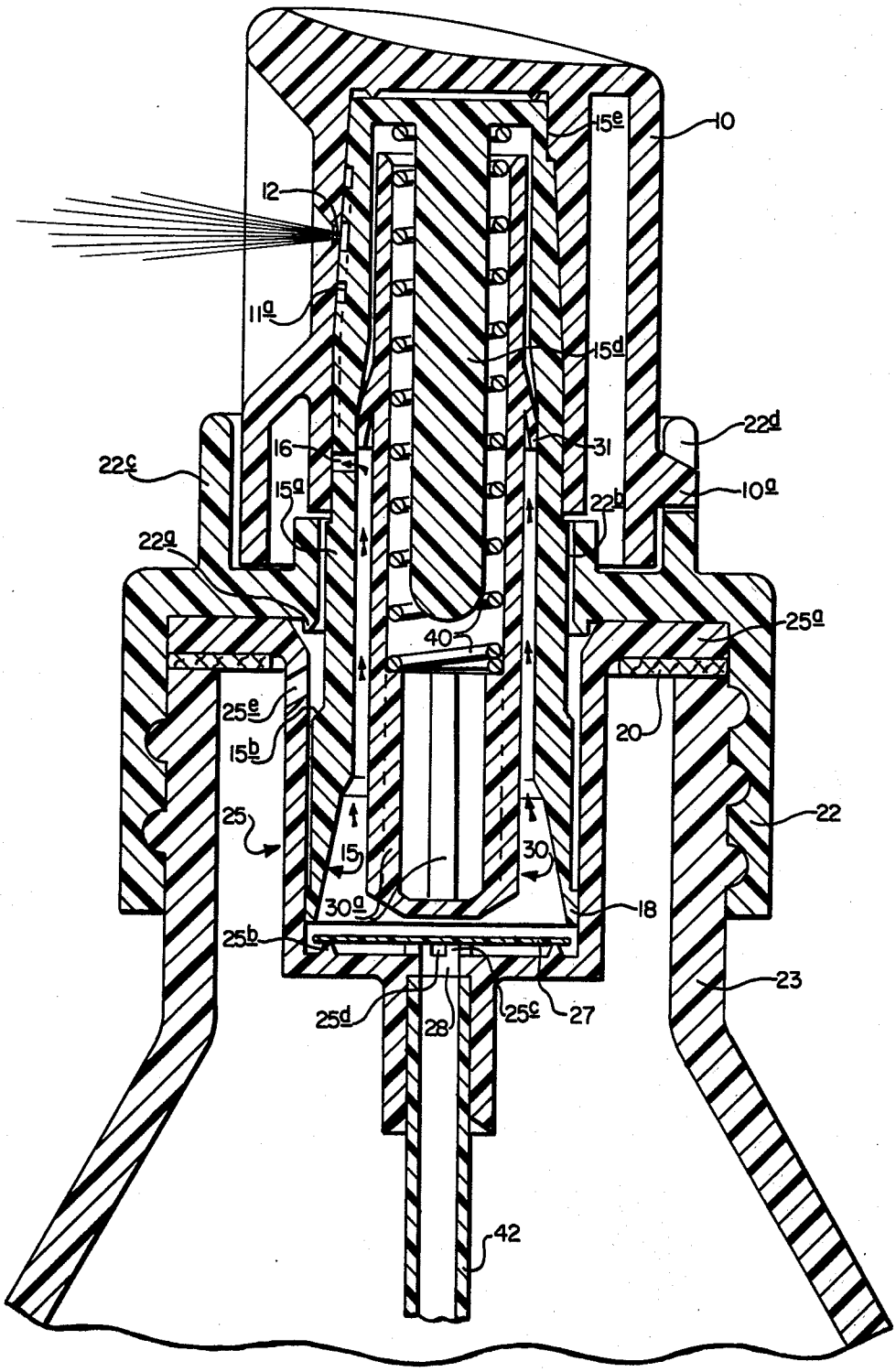
FIG. 2 is an enlarged fragmentary sectional view of the pump as the primary piston is being depressed.

At the bottom of tank 25 is circular valve 27. Circular valve 27 makes a seal with circular ridge **25*b* when actuator button 10 is depressed, as can be seen in FIG. 2. Circular valve 27 is held between tank 25, and post 25*c* and ridge 25*b*. Post 29*c* has channels 25*d* therein through which liquids may flow as indicated by the arrows in FIG. 3. If desired, circular valve 27** can be replaced with a conventional ball check valve.

At the lower end of tank 25 is an inlet passageway 28 to which is attached suction tube 42. The suction tube 42 is arranged to extend substantially to the bottom of container 23 to which the pump assembly may be connected.

Primary piston 15 is slidably contained within tank 25 by means of closure 22 which can be seen in the drawings to be a threaded cap screwed onto the threaded top of container 23. Closure 22 could also be attached to a suitable container by crimping, or the like. Closure 22 limits the upward movement of primary piston 15 when shoulders **15*b* of primary piston 15 strike shoulder 22*a* of closure 22. Closure 22 bears against flange 25*a* which is formed integrally with tank 25. The edge of the tank flange 25*a* may be snapped into the closure to prevent disassembly prior to placement on the container. Preferably a gasket 20 is placed between the flange 25*a* and the top of container 23** to prevent leakage around the spray pump assembly.

A circular cup **22*c*, having a slot 22*d* for receipt of tab 10*a* on button 10 is preferably integrally molded with closure 22. Button 10 can be depressed only when tab 10*a* is aligned to be received in slot 22*d*. To prevent actuation during shipment, tab 10*a* is turned from alignment with slot 22*d*. A flat portion or key 15*e* may be provided on primary piston 15 to assure alignment between outlet 12 and chamber 11*c***.

Figure 4:
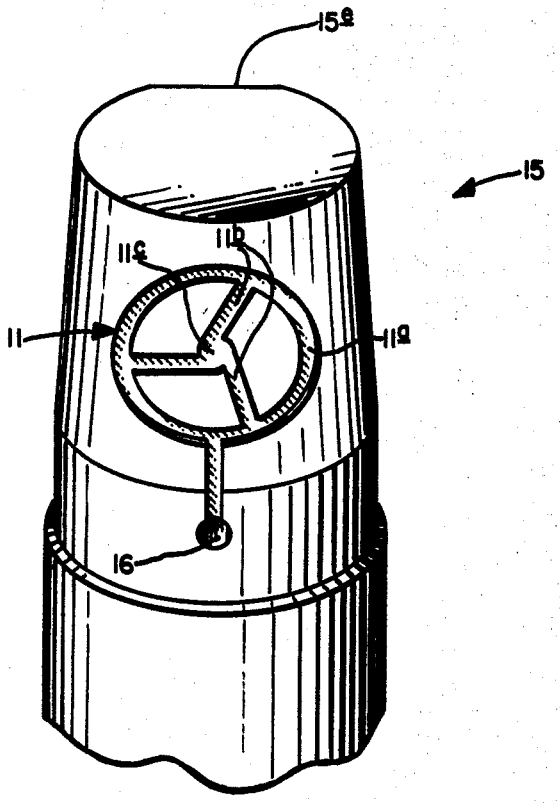

Primary piston 15 is generally hollow inside and has a hollow stem **15*a* which projects upwardly therefrom and which contains a liquid outlet passageway 16. As can best be seen in FIG. 4, passageway 16 permits liquid to flow into a mechanical break up swirl chamber generally indicated by the numeral 11 which is integrally molded on primary piston 15. The swirl chamber 11 includes a circular channel 11*a* which is connected to round chamber 11*c* by radial channels 11*b***.

Stem **15*a* is slidably received in circular opening 22*b* in closure 22. Vent 25*e* is located in tank 25 to permit air to flow into container 23. A cylindrical guide 15*d* extends downwardly from the inside of piston 15 into spring 40. At the lower end of primary piston 15 is scaling collar 18 which forms a seal with the inner wall of tank 25**.

Attached at the top of stem **15*a* is actuator button 10. Outlet 12 in actuator button 10 forms an exit for liquids passing outwardly through passageway 16 and channel 11**.

Secondary piston 30 can be seen in the drawings to be hollow inside and to be slidingly received in primary piston 15. At the upper end of the secondary piston 30 is located an annular scaling collar 31 which forms a seal with the inner wall of stem **15*a*. Piston 30 has a series of ridges 30*a* inside, the ends of which serve as a lower seat for spring 40**.

In the free-standing normal position shown in FIG. 1, the spring 40 forces secondary piston 30 against the bottom of tank 25 onto valve 27. In operation, the actuator button 10 is first depressed moving primary piston 15 downwardly, compressing spring 40. As piston 15 moves downwardly the fluid trapped in tank 25 transmits a pressure which keeps valve 27 closed as shown in FIG. 2. At a certain point during the downward travel of piston 15, the pressure within tank 25 reaches a point sufficient to overcome the spring pressure being exerted downwardly on secondary piston 30. At this point, secondary piston 30 begins to travel upward due to the upward force exerted against scaling collar 31 by the fluid in tank 25. Secondary piston 30 continues to move upward as the actuator button is depressed until the scaling collar 31 moves above liquid outlet passageway 16. At this point the fluid within tank 25 flows out of passageway 16 and channel 11 outwardly through exit 12 of actuator button 10. Then, once a sufficient pressure drop caused by escape of fluid is obtained, the spring returns so to its original rest position.

Figure 3:
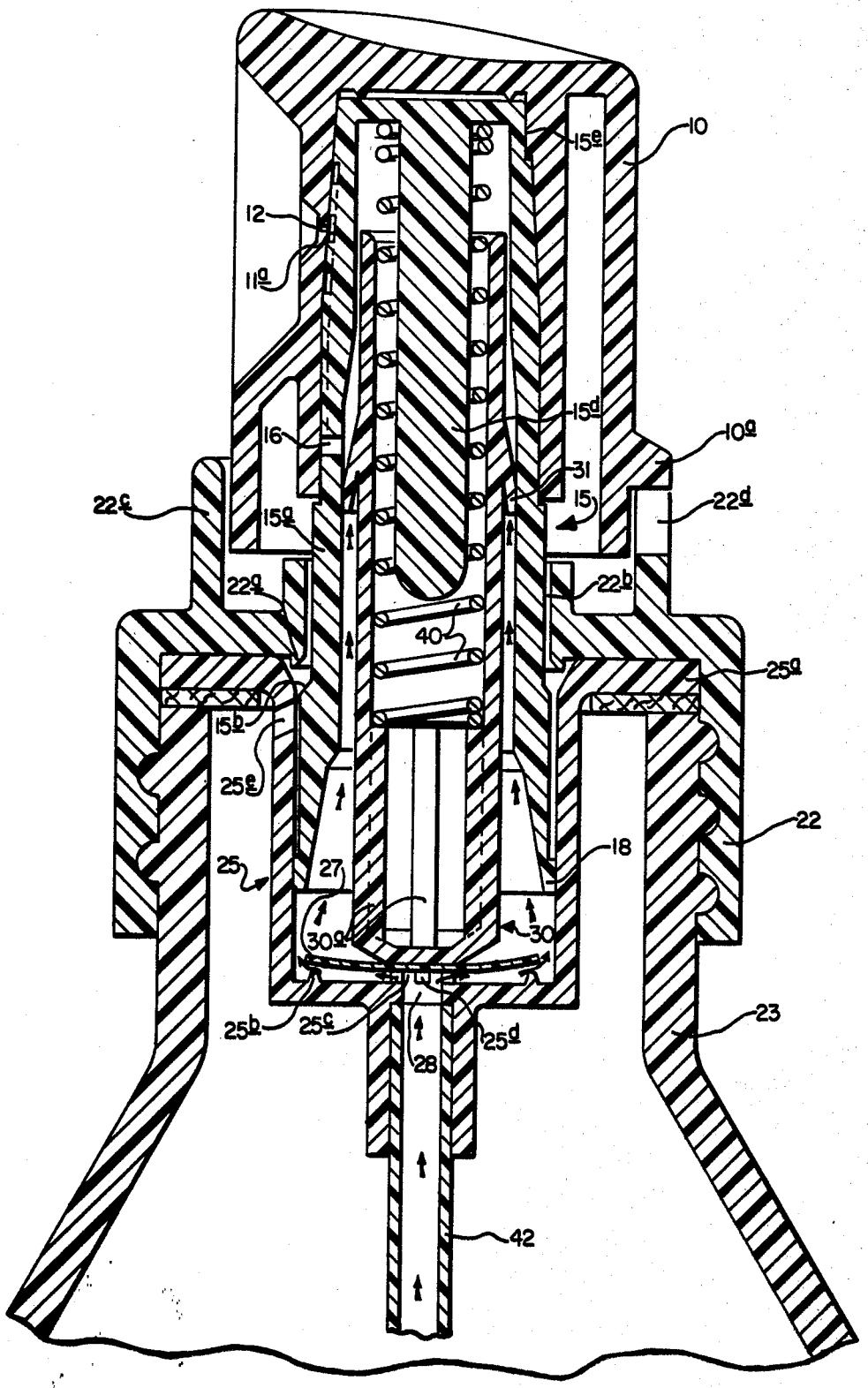
FIG. 3 is an enlarged fragmentary sectional view of the pump as the primary piston is rising; and, FIG. 4 is an enlarged fragmentary perspective view of the primary piston.

In FIG. 3, actuator button 10 is shown moving upwardly by spring pressure. The reduced pressure within compression chamber 26 caused by the upward movement of primary piston 15 draws liquid from container 23 through suction tube 42 and inlet 28 upward between valve 27 into tank 25, thus filling tank 25 with a new charge of liquid.

Having fully described the invention, it is desired that it be limited only within the spirit and scope of the attached claims.

What is claimed is:

1. A finger-operated spray pump assembly comprising:

a. tank means having a bottom end and a top end;

b. primary piston means slidably fitted for upward and downward movement in said tank means, said primary piston means having liquid passageway means;

c. secondary piston means slidably fitted for upward and downward movement inside said primary piston means and said tank means; and d. resilient means fitted inside said primary piston and said secondary piston means for biasing said primary piston means away from said secondary piston means.

2. The pump assembly of claim 1 wherein said tank means has valve means associated therewith to prevent the back flow of liquid from said tank means to suction tube means.

3. The pump assembly of claim 1 wherein said secondary piston means has annular scaling collar means for forming a seal with the inner wall of said primary piston means.

4. The pump assembly of claim 1 wherein said primary piston means has annular scaling collar means for forming a seal with the inner wall of said tank means.

5. The pump assembly of claim 1 wherein sand tank means has an internal cross-sectional area in a plane perpendicular to the directional movement of said primary piston means.

6. The pump assembly of claim 5 wherein said primary piston means and said secondary piston means are coaxially disposed for movement in the opposite direction.

7. The pump assembly of claim 5 wherein said liquid passageway means is located in the side wall of said primary piston means.

8. The pump assembly of claim 2 wherein said valve means comprises a flat, circular disc.

9. The pump assembly of claim 1 wherein said primary piston means has swirl chamber means integrally molded therewith.

10. The pump assembly of claim 9 wherein said swirl chamber means is connected to said liquid passageway means.

11. The pump assembly of claim 9 wherein said swirl chamber means includes a circular channel means connected to said passageway means, a circular chamber means, and a series of radial channel means connecting said circular channel means to said circular chamber means.

12. The pump assembly of claim 9 wherein said primary piston means has a flat key means at the upper end thereof to align actuator means with said swirl chamber means.

* * * * *

UNITED STATES PATENT AND TRADEMARK OFFICE

CERTIFICATE OF CORRECTION

PATENT NO. : 4,111,367

DATED : September 5, 1978

INVENTOR(S) : Thomas H. Hayes

It is certified that error appears in the above-identified patent and that said Letters Patent are hereby corrected as shown below:

Page 1, column 1, "Assignee: Ethyl Corporation, Richmond, Virginia" should read -- VCA Corporation, Baton Rouge, La. --.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*